US008080179B2

(12) United States Patent
Gotou et al.

(10) Patent No.: US 8,080,179 B2
(45) Date of Patent: Dec. 20, 2011

(54) DISPERSION COMPRISING THIN PARTICLES HAVING A SKELETON CONSISTING OF CARBONS, ELECTROCONDUCTIVE COATING FILM, ELECTROCONDUCTIVE COMPOSITE MATERIAL, AND A PROCESS FOR PRODUCING THEM

(75) Inventors: Takuya Gotou, Ibaraki (JP); Masahiro Fujiwara, Ibaraki (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 110 days.

(21) Appl. No.: 12/494,793

(22) Filed: Jun. 30, 2009

(65) Prior Publication Data

US 2009/0261302 A1 Oct. 22, 2009

Related U.S. Application Data

(62) Division of application No. 10/897,091, filed on Jul. 23, 2004, now abandoned.

(30) Foreign Application Priority Data

Jul. 23, 2003 (JP) ..... 2003-278181
Jul. 25, 2003 (JP) ..... 2003-280232

(51) Int. Cl.
*H01B 1/04* (2006.01)
*H01B 1/00* (2006.01)
*H01B 1/06* (2006.01)

(52) U.S. Cl. ..... 252/502; 252/500; 252/510

(58) Field of Classification Search ..... 252/500, 252/502, 510
See application file for complete search history.

(56) References Cited

U.S. PATENT DOCUMENTS

| | | | | |
|---|---|---|---|---|
| 2,798,878 | A | 7/1957 | Hummers, Jr. | |
| 3,549,560 | A * | 12/1970 | Monsimer | 252/500 |
| 6,416,815 | B2 * | 7/2002 | Greinke et al. | 427/220 |
| 2002/0054849 | A1 | 5/2002 | Baker et al. | |
| 2002/0093121 | A1 | 7/2002 | Greinke | |
| 2003/0116753 | A1 | 6/2003 | Norley et al. | |
| 2007/0131915 | A1 * | 6/2007 | Stankovich et al. | 252/511 |
| 2010/0303706 | A1 * | 12/2010 | Wallace et al. | 423/445 B |

FOREIGN PATENT DOCUMENTS

| | | |
|---|---|---|
| JP | 2002-053313 | 2/2002 |
| JP | 2002053313 A * | 2/2002 |
| JP | 2003-176116 A | 6/2003 |

OTHER PUBLICATIONS

Kotov, Nicholas A et al.; "Utrathin Graphite Oxide-Polyelectrolyte Composites Prepared by Self-Assembly: Transition Between Conductive and Non-Conductive States"; Adv. Mater, 1996, 8, No. 8, p. 637-641.

Nakajima, T. et al.; "A New Structure Model of Graphite Oxide"; Carbon, vol. 26, No. 3, pp. 357-361, 1988.

Mermoux, M. et al.; "FTIR and $^{13}$C NMR Study of Graphite Oxide"; Carbon, vol. 29, No. 3, pp. 469-474, 1991.

* cited by examiner

*Primary Examiner* — Mark Kopec
*Assistant Examiner* — Jaison Thomas
(74) *Attorney, Agent, or Firm* — Dickstein Shapiro LLP

(57) ABSTRACT

The invention provides a dispersion capable of producing an electroconductive coating film and an electroconductive composite material comprising thin particles having a skeleton consisting of carbons, which can, without any problem in film manufacturability, attain high electrical conductivity at a temperature as lower as possible without deteriorating the dispersed state of the thin particles, a produced material, and a process for producing them.

4 Claims, No Drawings

DISPERSION COMPRISING THIN PARTICLES HAVING A SKELETON CONSISTING OF CARBONS, ELECTROCONDUCTIVE COATING FILM, ELECTROCONDUCTIVE COMPOSITE MATERIAL, AND A PROCESS FOR PRODUCING THEM

CROSS REFERENCE TO RELATED APPLICATION

This is a division of application Ser. No. 10/897,091, filed Jul. 23, 2004, the disclosure of which is incorporated herein by reference.

FIELD OF THE INVENTION

The present invention relates to a dispersion comprising thin particles having a skeleton consisting of carbons, an electroconductive coating film, an electroconductive composite material, and a process for producing them.

RELATED ART (Thin Particles Having a Skeleton Consisting of Carbons)

With respect to thin particles having a skeleton consisting of carbons which are obtained by oxidizing graphite and dispersible in a liquid having a relative dielectric constant of 15 or more (also referred to hereinafter as "the thin particles"), there are the following known features and features disclosed by the present inventors.

As two-dimensional anisotropic substance having a skeleton of carbon atoms, there is graphite oxide obtained by oxidizing graphite. This graphite oxide is a multi-layer structure having two-dimensional basic layers laminated therein, and a multi-layer structure wherein the number of layers is very large is generally known. On the other hand, a very thin multi-layer structure wherein the number of layers is low has been also produced (see, for example, N. A. Kotov et al., Ultrathin Graphite Oxide-Polyelectrolyte Composites Prepared by Self-Assembly: Transition Between Conductive and Non-Conductive States, Adv. Mater., 8, 637 (1996)). The present inventors previously found a process for producing such thin particles of graphite oxide in high yield (graphite oxide wherein the number of layer is 1 is desirably called graphen oxide for example (graphen is a name of one layer of graphite)), and reduced the thin particles of graphite oxide to obtain thin particles resembling graphite wherein the number of layers is very small (graphite wherein the number of layer is 1 is desirably called graphen) (sec JP-A 2002-53313 and JP-A 2003-176116).

The basic layer of graphite oxide is considered to have a structure consisting of a carbon skeleton having the thickness of one or two carbon atoms (consisting of $sp^3$ carbon and $sp^2$ carbon, often $sp^3$ carbon) and acidic hydroxyl groups etc. bound to both sides of the skeleton (see, for example, T. Nakajima et al., A NEW STRUCTURE MODEL OF GRAPHITE OXIDE, Carbon, 26, 357 (1988), and M. Mermoux et al., FTIR AND $^{13}C$ NMR STUDY OF GRAPHITE OXIDE, Carbon, 29, 469 (1991)). When the carbon skeleton has the thickness of one carbon atom and has hydroxyl groups etc. in both sides thereof with a very small amount of interlaminar water, the thickness of the basic layer is 0.61 nm. When graphite is highly oxidized and well dried, the oxygen content in the graphite oxide is about 40 wt %.

It is known that the thin particles of graphite oxide are partially or completely reduced thereby assuming an electronic state having increased $sp^2$ bonds similar to the state of graphite, to increase electrical conductivity. Graphite oxide having increased electrical conductivity by reduction can be utilized in various fields such as semiconductor elements, wiring materials and antistatic fillers as semiconductors or conductors, and is very useful.

(Electroconductive Coating Film Comprising Thin Particles)

As the process for producing an electroconductive coating film blended with the thin particles having a skeleton consisting of carbons, which are obtained by oxidizing graphite and dispersible in a liquid having a relative dielectric constant of 15 or more, there is the following process. First, a dispersion of the thin particles, optionally blended with components such as a binder, a pigment, an adhesive component and a thickener, is applied onto the surface of a substrate, followed by removing the dispersing medium, to form a coating film on the surface of the substrate. To obtain electrical conductivity, the coating film is then heated at a temperature of about 200° C. or more to reduce the thin particles.

Alternatively, a process for producing the coating film in the same manner as above by using thin particles previously reduced to attain increased electrical conductivity can also be used. Heating for reduction, carried out after production of the film, is not necessary in this case. For previously reducing the thin particles, a method of using a reducing agent is known (see, for example, JP-A 2002-53313).

A method of reducing the thin particles with a reducing agent after production of the film would also be conceivable, but the reducing agent cannot penetrate into the produced film, thus resulting in the reduction of only the surface of the coating film. Accordingly, sufficient electrical conductivity is hardly achieved, and this method is inappropriate as the process of producing an electroconductive coating film.

(Electroconductive Composite Material Comprising Thin Particles)

As the process for producing an electroconductive composite material blended with the thin particles having a skeleton consisting of carbons, which are obtained by oxidizing graphite and dispersible in a liquid having a relative dielectric constant of 15 or more, there is the following process. First, materials serving as matrix (for example, a water-soluble polymer such as polyvinyl alcohol, polycarbonate, etc.) are dissolved or dispersed in, and mixed well with, a dispersion of the thin particles. Then, the dispersing medium is removed, whereby a composite material blended with the thin particles is formed. Thereafter, the composite material is heated at a temperature of about 200° C. or more to reduce the thin particles thereby giving electrical conductivity to the composite material. By the process described above, an electroconductive composite material blended with the thin particles is produced.

Alternatively, thin particles previously reduced to attain increased electrical conductivity can be used to produce a film by the same process as described above. Heating for reduction, carried out after production of the composite material, is not necessary in this case. For previously reducing the thin particles, a method of using a reducing agent is known (see, for example, JP-A 2002-53313).

An electroconductive composite material comprising the thin particles is produced by the process described above, and the electrical conductivity of the produced electroconductive composite material is influenced by the electrical conductivity of the incorporated thin particles. For example, the amount of the thin particles added can be reduced by increasing the electrical conductivity thereof, in order to attain the same electrical conductivity of the resulting composite material. As the amount of the thin particles is decreased, their influence on the properties of the material serving as matrix can be reduced, and it is thus preferable to decrease the amount of the added thin particles by increasing the electrical conductivity of the thin particles to the highest degree.

SUMMARY OF THE INVENTION

As described above, heating at a temperature of 200° C. or more or use of the previously reduced thin particles is required in the process for producing an electroconductive coating film comprising the thin particles having a skeleton consisting of carbons. In the process that involves heating at a temperature of 200° C. or more, there is a problem that when a substrate to be coated with the coating, or materials such as components incorporated into the dispersion to confer necessary functions on the coating film, are poor in heat resistance, they cannot be heated at a temperature necessary for attaining electrical conductivity, and thus sufficient electrical conductivity cannot be attained. When the previously reduced thin particles are used, there is a problem that due to reduction, the thin particles are aggregated in the dispersion so that when only the dispersion is used to produce a film, the dispersion is hardly uniformly applied, resulting in formation of a film having pits therein; when a binder or the like is simultaneously used, the thin particles occur unevenly in the resulting coating film.

In the electroconductive composite material comprising the thin particles, as described above, the electrical conductivity of the thin particles is preferably as high as possible in order to reduce the amount of the thin particles added. For attaining the electrical conductivity of the thin particles, there is a method of heating reduction or reduction with a reducing agent, but there are the following problems. In the case of heating reduction, the electrical conductivity of the thin particles can be increased as heating temperature is increased, but because heating is conducted after the composite material is produced, the temperature is limited depending on the heat resistance of the matrix material. Accordingly, when a material poor in heat resistance is used as the matrix material, sufficient electrical conductivity is hardly obtained. When a reducing agent is used, high electrical conductivity can be achieved, but because the thin particles are reduced in the dispersion, aggregation of the thin particles in the dispersion is initiated, and thus the dispersed state of the thin particles in the produced composite material is deteriorated. When the dispersed state is deteriorated, the electrical conductivity of the composite material is reduced, and as a result, the amount of the thin particles added should be undesirably increased.

From the foregoing, there is demand for a dispersion capable of producing an electroconductive coating film and an electroconductive composite material comprising the thin particles having a skeleton consisting of carbons, which can, without any problem in film manufacturability, attain high electrical conductivity at a temperature as lower as possible without deteriorating the dispersed state of the thin particles, a produced material, and a process for producing them.

The present inventors made extensive study for achieving the above object, and arrived at the present invention. That is, the present invention is as follows:

(1) A dispersion comprising thin particles, which essentially comprises the following components (a) to (c):

(a) thin particles having a skeleton consisting of carbons, obtained by oxidizing graphite and dispersible in a liquid having a relative dielectric constant of 15 or more;

(b) a dispersing medium for dispersing the thin particles; and (c) a compound having an action to reduce the thin particles.

(2) The dispersion according to the above-mentioned (1), wherein the component (c) is a compound having an action to reduce the thin particles during or after drying and removing the dispersing medium.

(3) The dispersion according to the above-mentioned (1), wherein the thin particles have a thickness of 0.4 nm to 100 nm and a size of 20 nm or more in the plane direction.

(4) The dispersion according to the above-mentioned (1), which further comprises a matrix material as component (d).

(5) A process for producing an electroconductive coating film comprising thin particles, which comprises applying the dispersion of the above-mentioned (1) onto a substrate and then drying and removing the dispersing medium.

(6) The process according to the above-mentioned (5), wherein the heating temperature during drying and removing the dispersing medium is in the range of 30 to 250° C.;

(7) An electroconductive coating film produced by the process of the above-mentioned (5).

(8) An antistatic coating film, an electromagnetic shielding coating film or an electroconductive wiring, which uses the electroconductive coating film of the above-mentioned (7).

(9) A process for producing an electroconductive composite material comprising thin particles, which comprises drying and removing the dispersing medium from the dispersion of the above-mentioned (4).

(10) The process according to the above-mentioned (9), wherein the heating temperature during drying and removing the dispersing medium is in the range of 30 to 250° C.

(11) An electroconductive composite material produced by the process of the above-mentioned (9).

(12) An electroconductive sheet, an electroconductive film, an antistatic sheet or an antistatic film, which uses the electroconductive composite material of the above-mentioned (11).

When the dispersion according to the present invention is used, the material of a substrate etc. can be selected for heat resistance from a broader range of materials in producing an electroconductive coating film comprising thin particles having a skeleton consisting of carbons. In production of the electroconductive composite material comprising thin particles having a skeleton consisting of carbons, the matrix material can be selected for heat resistance from a broader range of materials, and high electrical conductivity can be achieved by a small amount of the material added.

DESCRIPTION OF THE PREFERRED EMBODIMENTS (Dispersion Comprising Thin Particles)

The dispersion comprising thin particles according to the present invention comprises the following essential components: (a) thin particles having a skeleton consisting of carbons, obtained by oxidizing graphite and dispersible in a liquid having a relative dielectric constant of 15 or more, (b) a dispersing medium for dispersing the thin particles, and (c) a compound having an action to reduce the thin particles. Hereinafter, the respective components are described in detail.

(a) Thin Particles

The thin particles (a) obtained by oxidizing graphite, used in the present invention, can be graphite oxides produced by a known Brodie method (using nitric acid and potassium chlorate), Staudenmaier method (using nitric acid, sulfuric acid and potassium chlorate), Hummers-Offeman method (using sulfuric acid, sodium nitrate and potassium permanganate) and methods disclosed in JP-A 2002-53313 and JP-A 2003-176116 by the present inventors.

For example, JP-A 2002-53313 and JP-A 2003-176116 disclose the following methods.

First, the starting material used is desirably highly crystalline graphite having a developed layer structure, more specifically graphite having a single multi-layer structure as the whole of a particle wherein the diameter of the broadest basic layer in the particle is almost equal to the diameter of the particle. Such known graphite includes, for example, natural graphite (particularly the one having good qualities), kish graphite (particularly the one produced at high temperatures), and highly oriented pyrolyzed graphite. Distended graphite wherein the distance between graphite layers has been previously increased can also be used as the starting material. It is desirable that impurities such as metallic elements in graphite are previously reduced to about 0.5% or less.

The particle diameter of graphite reflects the size of the formed thin particle in the plane direction, and may thus be selected depending on the size of thin particles to be synthesized. When the shape in the plane direction of thin particles to be formed is desired to be e.g. square, the starting material of graphite may be previously cut in a square form.

For oxidation of graphite, the known methods described above can be used, and particularly the Hummers-Offeman method (W. S. Hummers et al., J. Am. Chem. Soc, 80, 1339 (1958); U.S. Pat. No. 2,798,878 (1957)) is recommended because their oxidation proceeds easily. In these methods, ions in an oxidizing agent permeate into between graphite layers to form an intercalation compound. Thereafter, the intercalation compound is hydrolyzed by adding water, to form graphite oxide. In this case, the graphite is oxidized for an oxidation time of 30 minutes or more, or if possible 3 hours or more, per 10 μm of the particle diameter of graphite.

After oxidation, the graphite oxide is purified by removing an oxidizing agent remaining in the reaction solution, ions generated by decomposition of the oxidizing agent, or components derived from the ions. This purification can be carried out by washing with water or alcohol, preferably with high-purity water. Before washing with water, the graphite oxide is preferably washed sufficiently with an aqueous solution of sulfuric acid or an aqueous mixture of sulfuric acid and hydrogen peroxide. In a specific procedure of purification with washing, known means such as decantation, filtration, centrifugation, dialysis and ion exchange can be used. When the purification procedure is made difficult as purification proceeds, techniques attaining relatively high efficiency of purification, such as centrifugation, dialysis and ion exchange are preferably used, and centrifugation is particularly preferably used.

By the procedure described above, layer separation proceeds in many particles of graphite oxide. When layer separation is to be further promoted, the dispersion may be sonicated or heated (preferably 50 to 150° C.).

As the thin particles used in the present invention, the graphite oxide obtained by the above method can be preferably used.

Particularly, graphite oxides having a thickness of 0.4 nm to 100 nm, preferably 0.4 nm to 10 nm, more preferably 0.4 nm to 5 nm and a size in the plane direction of 20 nm or more, preferably 1000 nm or more, more preferably 10000 nm or more, wherein the number of layers is very small, are very useful because their reduction proceeds easily due to the thinness of the particle and there is no other material having states and properties equivalent thereto. These graphite oxides can be produced by the methods disclosed in JP-A 2002-53313 and JP-A 2003-176116 supra. The size of the thin particles in the plane direction is selected suitably depending on the intended use and not particularly limited, but is usually 500 μm or less.

The thickness and size of the thin particles can be measured by observation under an atomic force microscope, a transmission electron microscope etc.

The content of the thin particles is preferably 0.0001 wt % to 20 wt %, more preferably 0.001 wt % to 10 wt %, still more preferably 0.01 wt % to 5 wt %, based on the total weight of the dispersion comprising thin particles according to the present invention.

When the thin particles are contained in this range, the electrical conductivity of the electroconductive coating film or electroconductive composite material obtained by using the dispersion of the present invention can be sufficiently increased. When the content of the thin particles is too low, there is the case where electrical conductivity is insufficient. On the other hand, when the content of the thin particles is too high, the properties of other components such as matrix material may be influenced.

(b) Dispersing Medium

Dispersing medium (b) for dispersing the thin particles used in the present invention is not particularly limited insofar as the thin particles (a) can be dispersed.

After synthesis of graphite oxide is finished, the dispersing medium in the dispersion is usually water, and this dispersing medium can be changed from water to a highly polar, non-water liquid having a relative dielectric constant of 15 of more, such as methanol, ethanol, acetone or 2-butanone. As means of exchanging the dispersing medium with a dispersing medium based on a highly polar, non-water liquid, there is a method of diluting the original dispersion with a highly polar, non-water liquid in a sufficiently larger amount than water contained in the dispersion, or a method of exchanging the dispersing medium gradually with a highly polar, non-water dispersing medium by repeatedly conducting addition of a highly polar, non-water liquid and subsequent removal of a supernatant by centrifugation and decantation.

A liquid wherein several kinds of liquids are mixed in a suitable ratio can also be used as the dispersing medium. In this case, a liquid having a relative dielectric constant of less than 15 may be partially used. The thin particles can be dispersed in a dispersing medium containing at least 50 wt % compound (for example, tetrahydrofuran, dioxane etc.) having a relative dielectric constant of less than 15 and compatible with water in an arbitrary ratio, and thus the liquid having a relative dielectric constant of less than 15 can be exceptionally used as a main dispersing medium.

(c) Compound Having an Action to Reduce the Thin Particles

As compound (c) having an action to reduce the thin particles used in the present invention, various reducing agents can be used. In particular, compound (c) is preferably a compound having an action to reduce the thin particles during or after drying and removing the dispersing medium. Compound (c) includes, for example, hydriodic acid, hydrazine, phosphinic acid, citric acid, sodium thiosulfate, ammonium thiosulfate, sodium hypophosphite, polyacrylic acid, L-(+)-ascorbic acid etc. Hydriodic acid has a reducing action during drying and removing the dispersing medium even at 60° C., and hydrazine has a low boiling point (114° C.) and is easily decomposed, and thus the reducing agent does not remain in the coating film. Phosphinic acid is low in toxicity. Each compound has the properties described above, and the optimum compound can be used depending on the intended use.

The amount of the reducing agent added is varied depending on the type of a reducing agent used and the intended use of the coating film, but usually the reducing agent is added such that the molar ratio of the reducing agent to the carbon atom in the thin particle is from 1/100 to 10, preferably from 1/10 to 2. This is because a sufficient reducing effect cannot be attained when the ratio is not higher than 1/100, and the electrical conductivity is undesirably reduced. On the other hand, when the reducing agent is added in a ratio of 10 or more, the reducing agent itself deteriorates electrical conductivity, and thus it is not preferable to add the reducing agent in an amount higher than necessary.

(d) Matrix Material

The dispersion comprising the thin particles according to the present invention can further comprise a matrix material (d).

As the matrix material (d), a material for example water-soluble polymers such as polyvinyl alcohol and polyethylene oxide, various kinds of thermoplastic resin and thermosetting resin, engineering plastics such as polycarbonate, inorganic polymers, etc. can be arbitrarily selected depending on the object. For highly dispersing the thin particles in the matrix material, a combination of the matrix material and the dispersing medium for dissolving the matrix material in the dispersion is desirably selected.

The content of the matrix material (d) is varied significantly depending on the intended use, but is preferably 0.01 wt % to 99 wt %, more preferably 0.1 wt % to 90 wt %, based on the total weight of the dispersion comprising the thin particles according to the present invention.

The dispersion comprising the thin particles according to the present invention can also comprise compounds specifically functioning as a pigment, dye, adhesive component, binder, thickener, aging inhibitor, filler, wax, softener, hardener, UV absorber, UV stabilizer, flame retardant, surface regulator and antistatic agent unless the object of the present invention is spoiled.

(Process for Producing an Electroconductive Coating Film)

The process for producing an electroconductive coating film comprises applying a dispersion of thin particles containing (a), (b) and (c) as the essential components onto a substrate and then drying and removing the dispersing medium. In this process, the thin particles are not previously reduced, and a mixture containing the thin particles before reduction and the reducing agent (in this mixture, almost all thin particles are not reduced) is used to form a film so that unlike reduction before preparation of a film, there does not arise a problem that the thin particles are aggregated in the dispersion to deteriorate film manufacturability. Further, high electrical conductivity can surprisingly be attained at lower temperatures without heating at about 200° C. after preparation of the film.

For example, the reducing agent such as citric acid, sodium thiosulfate, sodium hypophosphite and phosphinic acid in a dispersed slate hardly reduces the thin particles so that even if the dispersion containing the reducing agent is left for several days, the dispersed state of the thin particles does not change, and the film manufacturability is not problematic. However, when the dispersing medium is dried and removed, or the dispersion is heated at about 140° C. after drying and removing the dispersing medium after preparation of the film, the reduction of the thin particles is initiated, and sufficiently high electrical conductivity can be attained by heating for only about 10 minutes. When hydriodic acid is used, sufficiently high electrical conductivity can be attained by mere drying at 60° C. the reason that the reducing agent functions not in a dispersed state but during or after drying and removing the dispersing medium is not evident at present, but owing to this special effect, high electrical conductivity can be attained at low temperatures without deteriorating film manufacturability.

The method of applying the dispersion onto a substrate is not particularly limited, and generally known methods such as a spin coater method, bar coater method and roll coater method can be used. The method of drying and removing the dispersing medium is not particularly limited either, and may be any generally known method.

The heating temperature during or after drying and removing the dispersing medium is preferably 30° C. to 250° C., more preferably 35° C. to 225° C., still more preferably 40° C. to 200° C.

When the dispersion comprising the thin particles according to the present invention is used, the reduction of the thin particles can sufficiently proceed in the temperature range described above. When the temperature is too high, the properties of a substrate poor in heat resistance may be influenced, while when the temperature is too low, the desired electrical conductivity may not be obtained.

According to the process described above, an electroconductive coating film having an electrical conductivity in the range of $10^{-13}$ S/cm to $10^{6}$ S/cm can be easily produced.

Even if the thus produced electroconductive coating film of the present invention is applied onto a substrate poor in heat resistance, high electrical conductivity can be attained in a lower amount of the thin particles added.

The electroconductive coating film of the present invention can be used preferably in various applications such as antistatic coating film, electromagnetic shielding coating film and electroconductive wiring.

The electroconductive coating film, antistatic coating film, electromagnetic shielding coating film and electroconductive wiring produced by the process of the present invention are extremely useful because a material poor in heat resistance can be used in their starting material or a substrate onto which they are applied.

(Process for Producing an Electroconductive Composite Material)

The process for producing an electroconductive composite material comprises drying and removing the dispersing medium from the dispersion of thin particles containing (a), (b), (c), and a matrix material (d) as the essential components.

In this process for producing an electroconductive composite material, the thin particles are not previously reduced, and a mixture containing the thin particles before reduction and the reducing agent (in this mixture, almost all thin particles are not reduced) is used to form a composite material so that unlike reduction of the thin particles before preparation of a composite material, there does not arise a problem that the thin particles are aggregated in the dispersion to deteriorate dispersibility in the composite material. Further, high electrical conductivity can be attained without heating at about 200° C. after preparation of the composite material, and the attained electrical conductivity is higher than electrical conductivity attained by usual heating reduction.

For example, the reducing agent such as citric acid, sodium thiosulfate, sodium hypophosphite and phosphinic acid in a dispersed state hardly reduces the thin particles so that even if the dispersion containing the reducing agent is left for several days, the dispersed state of the thin particles does not change, and a composite material can be produced without deteriorating the dispersed state of the thin particles in the composite material. However, when the dispersion medium is dried and removed, or the dispersion is heated at about 140° C. after drying and removing the dispersing medium, the reduction of the thin particles is initiated, and sufficiently high electrical conductivity can be attained by heating for only about 15 minutes. The attained electrical conductivity is higher than attained by heating reduction at 200° C. in a system to which the reducing agent is not added. When hydriodic acid is used, sufficiently high electrical conductivity can be attained by mere drying at 60° C. The reason that the reducing agent functions not in a dispersed state but during or after drying and removing the dispersing medium is not evident at present, but owing to this special effect, high electrical conductivity can be attained at low temperatures without deteriorating dispersibility.

The heating temperature during or after drying and removing the dispersing medium is preferably 30° C. to 250° C., more preferably 35° C. to 225° C., still more preferably 40° C. to 200° C.

According to the present invention, the reduction of the thin particles can sufficiently proceed in the temperature range described above, and thus the electrical conductivity of the electroconductive composite material can be sufficiently increased. When the temperature is too high, the properties of a matrix material poor in heat resistance may be influenced, while when the temperature is too low, the desired electrical conductivity may not be obtained.

According to the process described above, an electroconductive composite material having an electrical conductivity in the range of $10^{-13}$ S/cm to $10^{6}$ S/cm can be easily produced.

The electroconductive composite material of the invention obtained in this manner can be used preferably in various fields such as electroconductive sheet, electroconductive film, antistatic sheet and antistatic film.

The electroconductive sheet, electroconductive film, antistatic sheet and antistatic film produced by the process of the present invention are extremely useful because even if a material poor in heat resistance is used, high electrical conductivity can be attained, and the electrical conductivity of the thin particles is high so that the amount of the particles added can be reduced.

EXAMPLES

Hereinafter, the present invention, is described in more detail by reference to the Examples, which however are not intended to limit the scope of the present invention.

Example 1

10 g natural graphite (purity 99.97 wt % or more) was introduced into a mixed solution consisting of 7.5 g sodium nitrate (purity 99%), 621 g sulfuric acid (purity 96%) and 45 g potassium permanganate (purity 99%), and the mixture was left at about 20° C. for 5 days under gentle stirring. The resulting highly viscous liquid was added to 1000 $cm^3$ of 5 wt % aqueous sulfuric acid over about 1 hour under stirring, and further stirred for 2 hours. 30 g hydrogen peroxide (30 wt % aqueous solution) was added to the resulting liquid and stirred for 2 hours.

This liquid was purified by centrifugation with an aqueous mixed solution of 3 wt % sulfuric acid/0.5 wt % hydrogen peroxide and centrifugation with water to give an aqueous dispersion of thin particles. From a change in weight of a part of the dispersion before and after drying, the density of the thin particles in the dispersion was 0.5 wt %. In element analysis of the thin particles vacuum-dried at 40° C., oxygen was about 42 wt %, and hydrogen was about 2 wt %. Hereinafter, this dispersion is called Dispersion A.

A dispersion having 70 mg hydriodic acid (57 wt % aqueous solution) added to 1 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 60° C. and 30 minutes. The resistance of the coating film was measured by a 2-terminal method, and the calculated electrical conductivity of the coating film was 84 (S/cm).

Example 2

A dispersion having 50 mg L-(+)-ascorbic acid added to 1 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes. The resistance of the coating film was measured by a 2-terminal method, and the calculated electrical conductivity of the coating film was 0.1 (S/cm).

Example 3

A dispersion having 50 mg L-(+)-ascorbic acid added to 1 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 1 (S/cm).

Example 4

A dispersion having 40 mg hydrazine added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 130° C. for 10 minutes. The resistance of the coating film was measured by a 2-terminal method, and the calculated electrical conductivity of the coating film was 56 (S/cm).

Example 5

A dispersion having 180 mg citric acid added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 0.5 (S/cm).

Example 6

A dispersion having 150 mg sodium thiosulfate added to 2 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 0.4 (S/cm).

Example 7

A dispersion having 150 mg ammonium thiosulfate added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 5 (S/cm). When ammonium thiosulfate on the surface was washed away with water, the electrical conductivity was 15 (S/cm).

Example 8

A dispersion having 120 mg sodium hypophosphite added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 0.5 (S/cm). When sodium hypophosphite on the surface was washed away with water, the electrical conductivity was 47 (S/cm).

Example 9

A dispersion having 30 mg phosphinic acid (30 wt % aqueous solution) added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 10 minutes. The resistance of the coating film was measured by a 2-terminal method, and the calculated electrical conductivity of the coating film was 86 (S/cm).

Example 10

A dispersion having 30 mg phosphinic acid (30 wt % aqueous solution) and 30 mg polyacrylic acid (average molecular weight about 5000) added to 3 g Dispersion A was prepared. The prepared dispersion was dropped onto a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 15 minutes. The resistance of the coating film was measured by a 2-terminal method, and the calculated electrical conductivity of the coating film was 2 (S/cm). When phosphinic acid on the surface was washed away with water, the electrical conductivity was 6 (S/cm).

Example 11

A dispersion having 30 mg phosphinic acid (30 wt % aqueous solution) and 100 mg acrylic coating (Tamiya Color, Tamiya Co., Ltd.) added to 3 g Dispersion A was prepared. The prepared dispersion was dropped onto a polycarbonate resin substrate (glass transition point 150° C.). The dispersing medium was dried and removed under the conditions of 70° C. and 10 minutes, and the resulting coating film was heat-treated at 140° C. for 15 minutes. The resistance of the coating film was measured by a 2-terminal method, and the calculated electrical conductivity of the coating film was 1 (S/cm).

Example 12

Dispersion A was diluted 10-fold with tetrahydrofuran (THF) and centrifuged, and a supernatant was removed. The sample was diluted again 10-fold with THF and centrifuged, and a supernatant was removed. The resulting THF dispersion of thin particles was designated Dispersion B. From a change in weight of a part of the dispersion before and after drying, the density of the thin particles in the dispersion was 1 wt %.

A dispersion having 0.1 g phosphinic acid (30 wt % aqueous solution) added to 20 g Dispersion B was prepared. 0.8 g polycarbonate resin was added to, and mixed uniformly with, the prepared dispersion, and the resulting liquid was dropped onto a polycarbonate resin substrate. The dispersing medium was dried and removed under the conditions of 70° C. and 10 minutes, and the resulting coating film was heat-treated at 140° C. for 15 minutes. The resistance of the coating film was measured by a 2-terminal method, and the calculated electrical conductivity of the coating film was 1 (S/cm).

Example 13

A dispersion having 30 mg phosphinic acid (30 wt % aqueous solution) and 600 mg polyacrylic acid (average molecular weight about 5000) added to 3 g Dispersion A was prepared. The prepared dispersion was applied onto a polycarbonate resin substrate (glass transition point 150° C.) having a surface rendered hydrophilic by corona discharge treatment. This application was conducted by a bar coater. The dispersing medium was dried and removed under the conditions of 70° C. and 10 minutes, and the resulting coating film was heat-treated at 140° C. for 15 minutes. When the electrical conductivity of the resulting film was measured, the electrical conductivity of the film was $2\times10^{-4}$ (S/cm). The electrical conductivity was determined from the thickness of the film and surface resistivity measured by a method according to JIS-K6911. A section of the film was cut off with an ultramicrotome and observed under a transmission electron microscope (TEM), indicating that the thickness of the thin particles was 10 nm or less.

Example 14

An aqueous dispersion of thin particles was prepared in the same manner as in Example 1 except that artificial graphite was used in place of natural graphite, and the resulting dispersion was designated Dispersion C. From a change in weight of a part of the dispersion before and after drying, the density of the thin particles in the dispersion was 3 wt %.

A dispersion having 2.5 g water, 30 mg phosphinic acid (30 wt % aqueous solution) and 600 mg polyacrylic acid (average molecular weight about 5000) added to 0.5 g Dispersion C was prepared. The prepared dispersion was applied onto a polycarbonate resin substrate (glass transition point 150° C.) having a surface rendered hydrophilic by corona discharge treatment. This application was conducted by a bar coater. The dispersing medium was dried and removed under the conditions of 70° C. and 10 minutes, and the resulting coating film was heat-treated at 140° C. for 15 minutes. When the electrical conductivity of the resulting film was measured, the electrical conductivity of the film was $2\times10^{-8}$ (S/cm). The electrical conductivity was determined from the thickness of the film and surface resistivity measured by a method according to JIS-K6911. A section of the film was cut off with an ultramicrotome and observed under a transmission electron microscope (TEM), indicating that the thickness of the thin particles was about 200 nm. Although the amount of the thin particles added to polyacrylic acid was the same as in Example 13, the thin particles were so thick that the electrical conductivity of the film was worse than in Example 13.

Comparative Example 1

Dispersion A was dropped on a polycarbonate resin substrate (glass transition point 150° C.) having a surface rendered hydrophilic by corona discharge treatment. The dispersing medium was dried and removed under the conditions of 70° C. and 10 minutes, and the resulting coating film was heat-treated at 140° C. for 30 minutes. The resistance of the coating film was measured by a 2-terminal method, and the calculated electrical conductivity of the coating film was $1\times10^{-5}$ (S/cm) or less.

Comparative Example 2

A dispersion having 600 mg polyacrylic acid (average molecular weight about 5000) added to 3 g Dispersion A was prepared. The prepared dispersion was applied onto a polycarbonate resin substrate (glass transition point 150° C.) having a surface rendered hydrophilic by corona discharge treatment. This coating was conducted by using a bar coater. The dispersing medium was dried and removed under the conditions of 70° C. and 10 minutes, and the resulting coating film was heat-treated at 140° C. for 15 minutes. When the electrical conductivity of the resulting film was measured, the electrical conductivity of the film was $1\times10^{-10}$ (S/cm) or less. The electrical conductivity was determined from the thickness of the film and surface resistivity measured by a method according to JIS-K6911.

Example 15

A dispersion having 2.8 g hydriodic acid (57 wt % aqueous solution) added to 40 g Dispersion A was prepared. 0.8 g polyvinyl alcohol was added to, and mixed uniformly with, the prepared dispersion. The dispersing medium was dried and removed under the conditions of 60° C. and 60 minutes to prepare a film. The resistance of the film was measured by a 2-terminal method, and the calculated electrical conductivity of the film was 2 (S/cm).

Example 16

A dispersion having 0.4 g phosphinic acid (30 wt % aqueous solution) added to 40 g Dispersion A was prepared. 0.8 g polyvinyl alcohol was added to, and mixed uniformly with, the prepared dispersion. The dispersing medium was dried and removed under the conditions of 70° C. and 10 minutes to prepare a film. Thereafter, the film was heat-treated at 140° C. for 15 minutes. The resistance of the film was measured by a 2-terminal method, and the calculated electrical conductivity of the film was 3 (S/cm).

Example 17

A dispersion having 0.4 g phosphinic acid (30 wt % aqueous solution) added to 20 g Dispersion B was prepared. 0.8 g polycarbonate resin was added to, and mixed uniformly with, the prepared dispersion. The dispersing medium was dried and removed under the conditions of 70° C. and 10 minutes to prepare a film. Thereafter, the film was heat-treated at 140° C. for 15 minutes. The resistance of the film was measured by a 2-terminal method, and the calculated electrical conductivity of the coating film was 1 (S/cm).

Because the heating temperature was lower than the glass transition point of the resin, the shape of the film was maintained after heating.

Example 18

A dispersion having 0.4 g phosphinic acid (30 wt % aqueous solution) added to 20 g Dispersion B was prepared. 5 g polycarbonate resin was added to, and mixed uniformly with, the prepared dispersion. The dispersing medium was dried and removed under the conditions of 70° C. and 10 minutes to prepare a film. Thereafter, the film was heat-treated at 140° C. for 15 minutes. The electrical conductivity of the heat-treated film was $1\times10^{-5}$ (S/cm). The electrical conductivity was determined from volume resistivity measured by a method according to JIS-K6911. A section of the film was cut off with an ultramicrotome and observed under a transmission electron microscope (TEM), indicating that the thickness of the thin particles was 50 nm.

Example 19

Dispersion C was diluted 10-fold with tetrahydrofuran (THF) and centrifuged, and a supernatant was removed. The sample was diluted again 10-fold with THF and centrifuged, and a supernatant was removed. The resulting dispersion of thin particles was designated Dispersion D. From a change in weight of a part of the dispersion before and after drying, the density of the thin particles in the dispersion was 1 wt %.

A dispersion having 0.4 g phosphinic acid (30 wt % aqueous solution) added to 20 g Dispersion D was prepared. 5 g polycarbonate resin was added to, and mixed uniformly with, the prepared dispersion. The dispersing medium was dried and removed under the conditions of 70° C. and 10 minutes to form a film. Thereafter, the film was heat-treated at 140° C. for 15 minutes. The electrical conductivity of the heat-treated film was $1\times10^{-9}$ (S/cm). The electrical conductivity was determined from volume resistivity measured by a method according to JIS-K6911. A section of the film was cut off with an ultramicrotome and observed under a transmission electron microscope (TEM), indicating that the thickness of the thin particles was about 200 nm. Although the amount of the thin particles added to the film was the same as in Example 18, the thin particles were so thick that the electrical conductivity of the film was worse than in Example 18.

Comparative Example 3

A polyvinyl alcohol film blended with thin particles was prepared in the same manner as in Example 15 except that hydriodic acid was not added. The resistance of the film was measured by a 2-terminal method, and the calculated electrical conductivity of the film was $1\times10^{-8}$ (S/cm) or less.

Comparative Example 4

A polycarbonate resin film blended with thin particles was prepared in the same manner as in Example 17 except that phosphinic acid was not added. Thereafter, the film was heat-treated at 200° C. for 60 minutes. The electrical conductivity of the heat-treated film was 0.04 (S/cm). The electrical conductivity was determined from volume resistivity measured by a method according to JIS-K6911. The heating temperature was higher and the treatment time was longer than in Example 17, but the electrical conductivity of the resulting film was lower than in Example 17.

Because the film was heated to a temperature higher than the glass transition point of the resin, deformation of the film was confirmed.

The invention claimed is:

1. A process for producing an electroconductive coating film comprising thin particles, said process comprising:

oxidizing graphite to form thin particles having a skeleton consisting of carbons and being dispersible in a liquid having a dielectric constant of 15 or more, with an oxidizing agent wherein any intercalation compounds formed during oxidation are hydrolyzed via the subsequent addition of water;

forming a dispersion comprising oxidized graphite, a dispersion medium, and a compound having an action to reduce the thin particles consisting essentially of oxidized graphite, thereby rendering the thin particles electroconductive after reduction, during or after drying and removing the dispersing medium and not substantially to reduce the thin particles before drying and removing the dispersing medium;

applying the dispersion onto a substrate and then drying and removing the dispersing medium.

2. The process according to claim 1, wherein the heating temperature during drying and removing the dispersing medium is in the range of 30 to 250° C.

3. A process for producing an electroconductive composite material comprising thin particles, said process comprising:

oxidizing graphite, to form thin particles having a skeleton consisting of carbons and being dispersible in a liquid having a dielectric constant of 15 or more, with an oxidizing agent wherein any intercalation compounds formed during oxidation are hydrolyzed via the subsequent addition of water;

forming a dispersion comprising oxidized graphite, a dispersion medium, a compound having an action to reduce the thin particles consisting essentially of oxidized graphite and a matrix material, thereby rendering the thin particles electroconductive after reduction, during or after drying and removing the dispersing medium and not substantially to reduce the thin particles before drying and removing the dispersing medium;

applying the dispersion onto a substrate and then drying and removing the dispersing medium.

4. The process according to claim 3, wherein the heating temperature during drying and removing the dispersing medium is in the range of 30 to 250° C.

* * * * *